United States Patent [19]

Kobayashi

[11] Patent Number: 4,543,069

[45] Date of Patent: Sep. 24, 1985

[54] AUXILIARY PROPELLING EQUIPMENT MOUNTING STRUCTURE FOR SAIL BOATS

[75] Inventor: Yoshiaki Kobayashi, Hamamatsu, Japan

[73] Assignee: Yamaha Hatsudoki Kabushiki Kaisha, Iwata, Japan

[21] Appl. No.: 618,760

[22] Filed: Jun. 8, 1984

Related U.S. Application Data

[63] Continuation of Ser. No. 362,242, Mar. 26, 1982, abandoned.

[30] Foreign Application Priority Data

Apr. 16, 1981 [JP] Japan ..... 56-58133
May 23, 1981 [JP] Japan ..... 56-78229
Aug. 31, 1981 [JP] Japan ..... 56-137224

[51] Int. Cl.[4] ..... B63H 5/00

[52] U.S. Cl. ..... 440/112; 277/207 A; 277/212 FB

[58] Field of Search ..... 440/112, 111, 54; 277/212 FB, 207 R, 207 A, 208, 209, 211

[56] References Cited

U.S. PATENT DOCUMENTS 3,511,061 5/1970 Burchhardt ..... 277/212 FB
3,669,057 6/1972 Shimancbas ..... 440/112
3,982,496 9/1976 Blanchard ..... 440/112
4,040,378 8/1977 Blanchard ..... 440/112
4,194,750 3/1980 Souish et al. ..... 277/208
4,236,478 12/1980 Mansson ..... 440/112
4,293,138 10/1981 Swantee ..... 277/209
4,327,925 5/1982 Alexander et al. ..... 277/212 FB

FOREIGN PATENT DOCUMENTS 130796 10/1978 Japan .
1569661 6/1980 United Kingdom .

*Primary Examiner*—Sherman D. Basinger
*Attorney, Agent, or Firm*—Ernest A. Beutler

[57] ABSTRACT

Several embodiments of improved sealing arrangements for sealingly engaging an auxiliary power unit and the portion of the hull of a water craft that defines an opening through which the power unit drive extends. In each embodiment the seal has an opening that is sized to pass the power unit and an arrangement is provided for forcing the seal into sealing engagement with the power unit. In some embodiments two axially spaced seals are provided and an arrangement is incorporated for limiting the degree of relative movement by the power unit and the hull. In one embodiment a water sensor is positioned in the area between the two spaced seals for detecting failure of one of the seals. The support for the sensor is such that it may be removed and inserted along with the power unit without damage to the seal.

12 Claims, 6 Drawing Figures

AUXILIARY PROPELLING EQUIPMENT MOUNTING STRUCTURE FOR SAIL BOATS

This application is a continuation of application Ser. No. 362,242, filed Mar. 26, 1982 and now abandoned.

BACKGROUND OF THE INVENTION

This invention relates to an auxiliary propelling equipment mounting arrangement for sail boat or other water craft, and more particularly to an improved sealing structure and leakage detection device therefor.

Many forms of sail boats employ an auxiliary propelling unit such as an engine and drive unit that may be mounted so as to extend through a hole in the hull. As is well known, it is desirable to remove such propelling unit when not in use so as to avoid unnecessary drag from the drive unit. It is desirable to provide an effective seal between the auxiliary propelling unit and the hull when the propelling unit is in place to prevent leakage. Such a seal should be highly effective and yet must permit ease of insertion and removal of the auxiliary power unit. In one form of prior art arrangement the seal is provided by an O-ring-like member that is carried by the auxiliary propelling unit and which is adapted to sealingly engage a portion of the hull that defines the opening when the power unit is in place. Such arrangements have a number of disadvantages. In the first instance, considerable insertion force is required to insure effectiveness of the seal. Furthermore, since the seal is carried by the auxiliary power unit, it is prone to damage particularly upon successive insertions and removals; thus, rendering the seal ineffective. This type of seal also does not permit any wide degree of movement and, thus, affords no vibration damping, which is undesirable with this type of installation.

It is, therefore, a principal object of this invention to provide an improved sealing arrangement for an auxiliary power unit of a watercraft.

It is a further object of the invention to provide an auxiliary power unit seal that permits ease of installation or removal of the power unit, while minimizing the likelihood of damage to the seal.

It is yet a further object of this invention to provide a sealing arrangement for an auxiliary power unit which permits a wide degree of relative movement generated by vibrations while at the same time maintaining an effective seal.

In conjunction with the use of seals that permit large degree of relative movement so as to minimize the transmission of vibrations to the hull, it is essential that an arrangement be incorporated which will minimize the likelihood of damage under large magnitude movements such as may be encountered if a submerged object is struck by the power unit. It is desirable to avoid direct solid contact between the power unit and the hull under such conditions. If the power unit is permitted to directly strike the hull, damage might well occur.

It is, therefore, a yet further object of this invention to provide a resilient seal for an auxiliary marine power unit that incorporates a resilient damping device for large magnitude movements.

In order to provide an effective seal around the auxiliary power unit of a water craft, it has been proposed to provide a double seal arrangement consisting of a lower seal and an upper seal that define a cavity of space between the two seals. Such a double sealing arrangement provides additional sealing protection in the event one of the seals deteriorates or becomes damaged. If, on the other hand, the lower seal becomes damages, the leakage past it may not be noticed and the seal may not be repaired in time. It has, therefore, been proposed to provide some form of sensing device which senses the presence of water between the two seals to provide an indication that one of the seals has failed. However, it is important that the sensing device by mounted in such a way that it will not interfere with removal and insertion of the auxiliary power unit. Furthermore, the arrangement should insure that the sensing unit will not be damaged upon power unit replacement or removal, or that the seal itself will be damaged on such removals or insertions. It has been proposed to mount the sensing unit directly upon the seal. If this is done, it must be insured that the connection of the sensing unit to the seal does not itself leak. To avoid this problem, it has been proposed to form the sensing unit as an integral part of the seal. However, this also has a disadvantage. If either the seal of the sensing unit becomes damaged, it is necessary to replace both units.

It is therefore, a further object of this invention to provide a improved leakage sensing arrangement for the seal of a marine auxiliary propullsion unit.

SUMMARY OF THE INVENTION

A first feature of the invention is adapted to be embodied in a sealing arrangement for a hull and an auxiliary power unit wherein the hull defines an opening through which a portion of the auxiliary power unit is adapted to pass. The sealing arrangement includes an elastomer seal that is adapted to provide an operative seal between the hull and the power unit. In accordance with this feature of the invention, the elastomer seal has a first portion for sealingly engaging the area around the hole and which is substantially affixed relative thereto. A second part of the elastomer seal defines an opening that is sized to slidably engage the power unit and to permit insertion and removal of the power unit through the opening when the first portion is sealingly engaged with the area around the hole. Means are provided for detachably affixing the second part in sealing engagement with the power unit portion.

Yet another feature of the invention is also adapted to be embodied in a hull and auxiliary power unit sealing arrangement. In accordance with this feature of the invention an elastomer seal has a first portion for sealingly engaging the area around the hole, and a second portion spaced from the first portion and adapted to sealingly engage the auxiliary power unit. The first and second sealing portions are connected by a resilient section for permitting vibration of the auxiliary power unit relative to the hull. A third portion is provided that is adapted to be affixed relative to either the hull and the auxiliary power unit and which is normally spaced from the other. The third portion is resilient and is adapted to engage the other components for limiting the relative movement.

Yet a further feature of the invention is also adapted to be embodied in a hull and auxiliary power unit sealing arrangement. A sealing arrangement according to this feature includes a lower seal between the power unit and the hull, and an upper seal between the power unit and the hull. The upper and lower seals define a sealed space therebetween. In accordance with this feature, water sensor means are carried by the portion of the power unit positioned between the seals for sensing the presence of water in the space therebetween.

PRIOR ART

Figure 1:
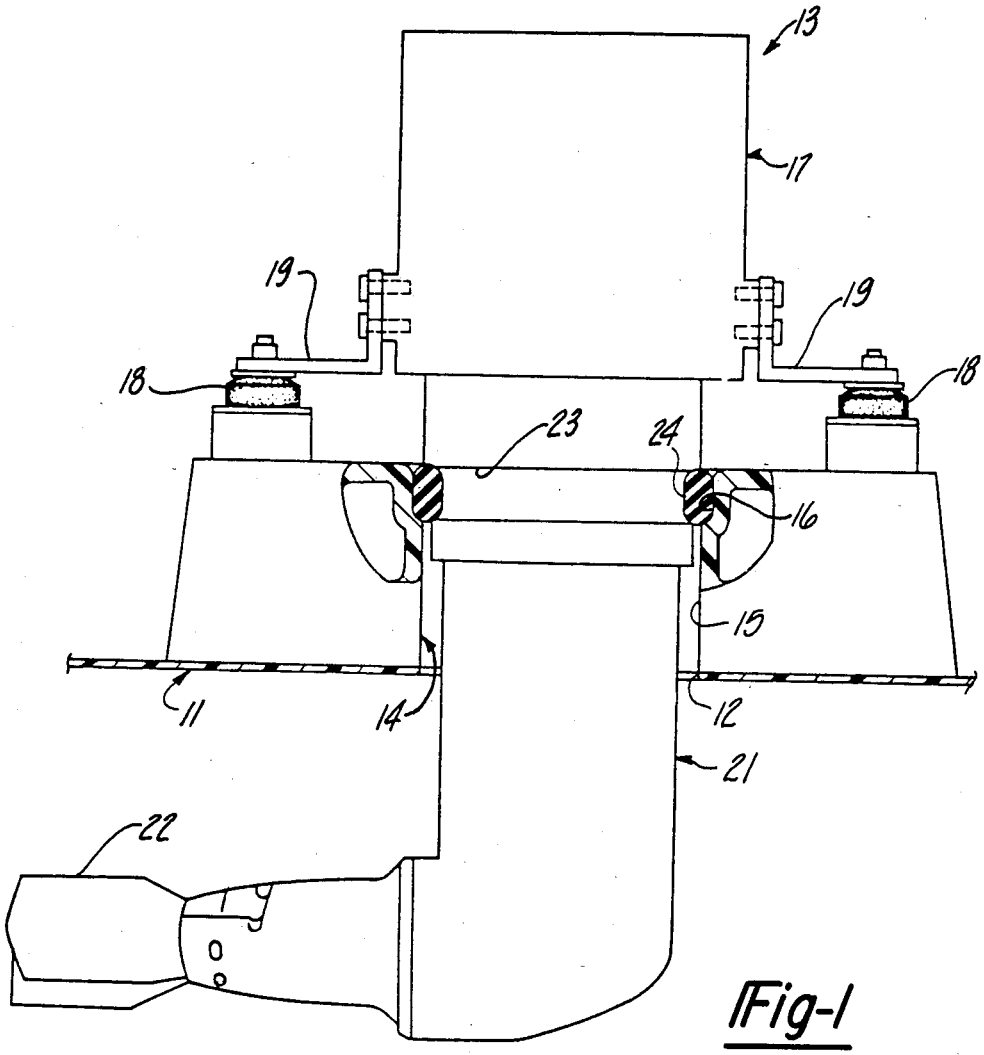
Fig-1 PRIOR ART
FIG. 1 is a side elevational view, with portions broken away and other portions shown in section, of a portion of a water craft showing an auxiliary power unit mounted in its operative position in accordance with a prior art construction.

Referring first to FIG. 1, a portion of the lower part of the hull of a sail boat is identified generally by the reference numeral 11. The hull 11 defines an opening 12 that is adapted to pass an auxiliary power unit 13 for auxiliary drive of the sail boat under power.

An auxiliary power unit support, indicated generally by the reference numeral 14, is affixed in any suitable manner to the hull 11. The support 14 defines a central opening 15 that is aligned with and forms an extension of the hull opening 12. The support 14 and hull 11 are sealed around the opening 12. The upper end of the opening 15 is formed with a sealing recess 16 for a purpose to be described.

The auxiliary power unit 13 includes any known type of internal combustion engine, shown schematically at 17. The engine 17 is supported on the support 14 by means of resilient engine mounts 18 and brackets 19.

A drive unit 21 is affixed to the engine 17 and depends through the support opening 15 and hull opening 12 into the water. The lower end of the drive unit 21 carried the propeller 22 that is driven by means of a drive shaft and transmission assembly contained within the drive unit 21, as is well known in the art.

The drive unit 21 is formed with a circumferential recess 23 in which an O-ring 24 is trapped. When the auxiliary power unit 13 is in use, the O-ring 24 will be forced into sealing engagement with the seal recess 16 of the support 14. In order to insure good sealing particularly if there are manufacturing variations in the size and shape of the recess 16 with this prior art type of construction, considerable force must be applied to the O-ring 24 to insure its sealing in the recess 16. Because such high forces are required to achieve good sealing, the O-ring 24 is not capable of any sufficient vibration damping. In addition, there is always danger that the O-ring seal 24 will be damaged since it must be removed along with the auxiliary power unit 13 when the auxiliary power unit 13 is not operative to drive the boat.

DETAILED DESCRIPTION OF THE PREFERRED EMBODIMENTS

In describing the preferred embodiments the auxiliary power unit, hull and supporting structure are substantially the same as in the prior art. Only the various embodiments of seal structures and the manner of incorporation of a sensor depart from the prior art as described. For that reason components which are the same, or substantially the same, as in the prior art thus described have been identified by the same reference numerals. Further description of these components will be repeated only insofar as necessary to understand the construction and operation of each embodiment.

Figure 2:
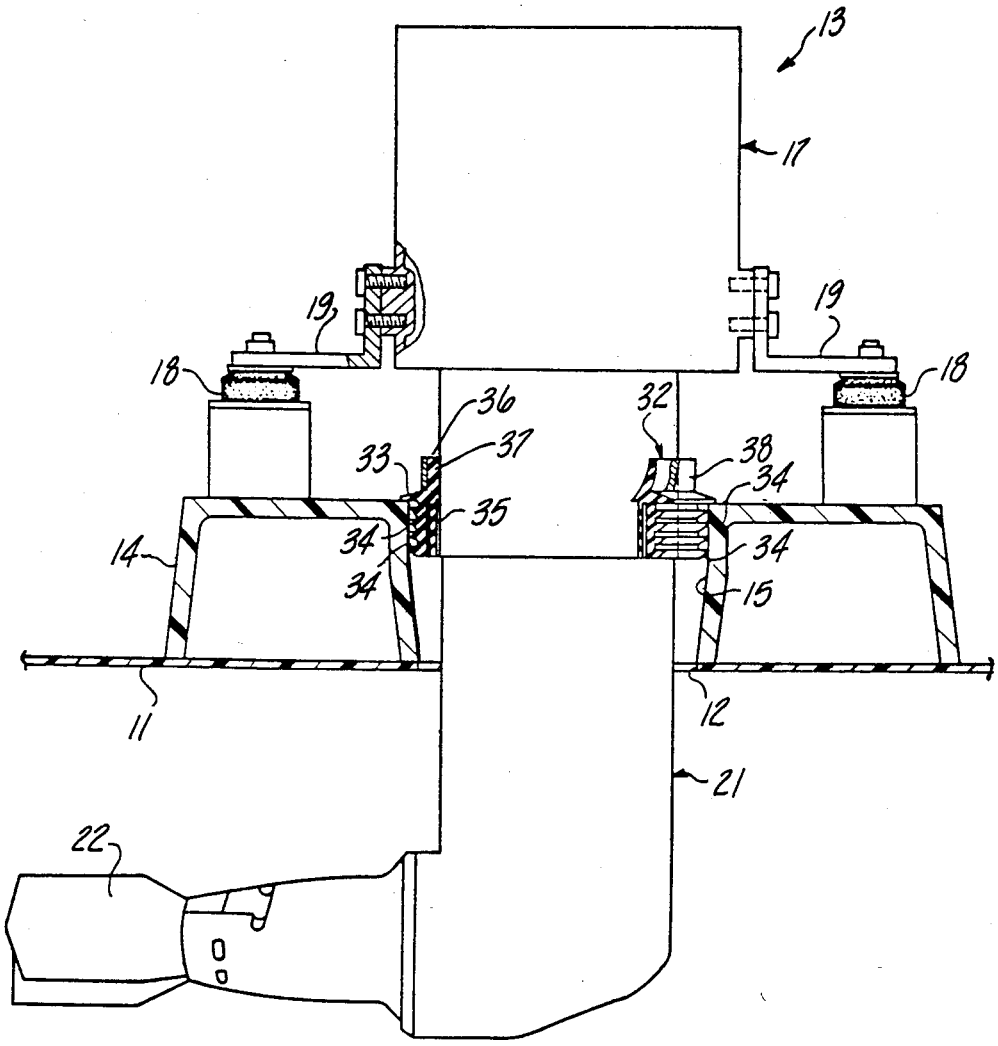
FIG. 2 is a side elevational view, in part similar to FIG. 1, with portions broken away and other portions shown in section, of a sealing arrangement constructed in accordance with a first embodiment of the invention.

Embodiment of FIG. 2

In this embodiment the support 14 is substantially as in the prior art; however, a sealing recess is not required in the support opening 15. A seal constructed in accordance with this embodiment is identified generally by the reference numeral 32. The seal 32 is generally annular in configuration and if formed primarily from a suitable elastomer material such as rubber. The seal 32 is formed with a radially outwardly extending flange 33 that is adapted to sealingly engage the upper surface of the support 14 around the opening 15 to provide a first seal in this area. In addition, the seal 32 is formed with a plurality of circumferential radially extending ribs 34 that are slightly larger in diameter than the adjacent portion of the opening 15 but which are smaller in diameter than the flange 33. The ribs have a generally saw-like shape with sharp outer edges. When the seal 32 is pressed into the opening 15, the ribs 34 will be resiliently deflected and form a tight seal with the support 14 around the opening 15. In order to further improve this seal, a rigid annular reinforcing member 35 may be molded into the seal 32 adjacent the base of the ribs 34.

The seal 32 is formed with an integral upstanding sleeve portion 36 having an opening 37 that is normally sized so as to freely pass the auxiliary power unit drive unit 21. A metal clamp or the like 38 is adapted to encircle the sleeve portion 36 and when clamped provides a water tight seal between the sleeve 36 and the drive unit 21.

In use, the seal 32 may be initially slid over the drive unit 21 and loosely clamped thereto by tightening the clamp 38. When the power unit 13 is then inserted through the opening 15 and hole 12, the seal ribs 34 will engage and seal the opening 15 and the flange 33 will engage the upper surface of the support 14 and provide a seal in this area. The clamp 38 may then be final tightened.

When it is desired to remove the auxiliary power unit 13, the clamp 38 is released so that the opening 37 relaxes to a state wherein the drive unit 21 may be slid through it. The engagement of the ribs 34 with the opening 15 will hold the seal 32 in place on the support 14. Thus, the likelihood of damage to the seal 32 during successive insertion and removals of the auxiliary power unit 13 will be reduced. Furthermore, an effective seal is provided with both the power unit 13 and with the support 14 so as to reduce the likelihood of leakage.

In connection with this embodiment, a plurality of sealing ribs 34 are provided. It is to be understood that the number of such ribs may be readily varied to suit particular applications, and, in some embodiments, only a single rib need by employed. The provision of ribs 34 in addition to insuring good sealing also provides a resilient arrangement wherein the vibrations of the engine 17 will be effectively isolated from the support 14.

Figure 3:
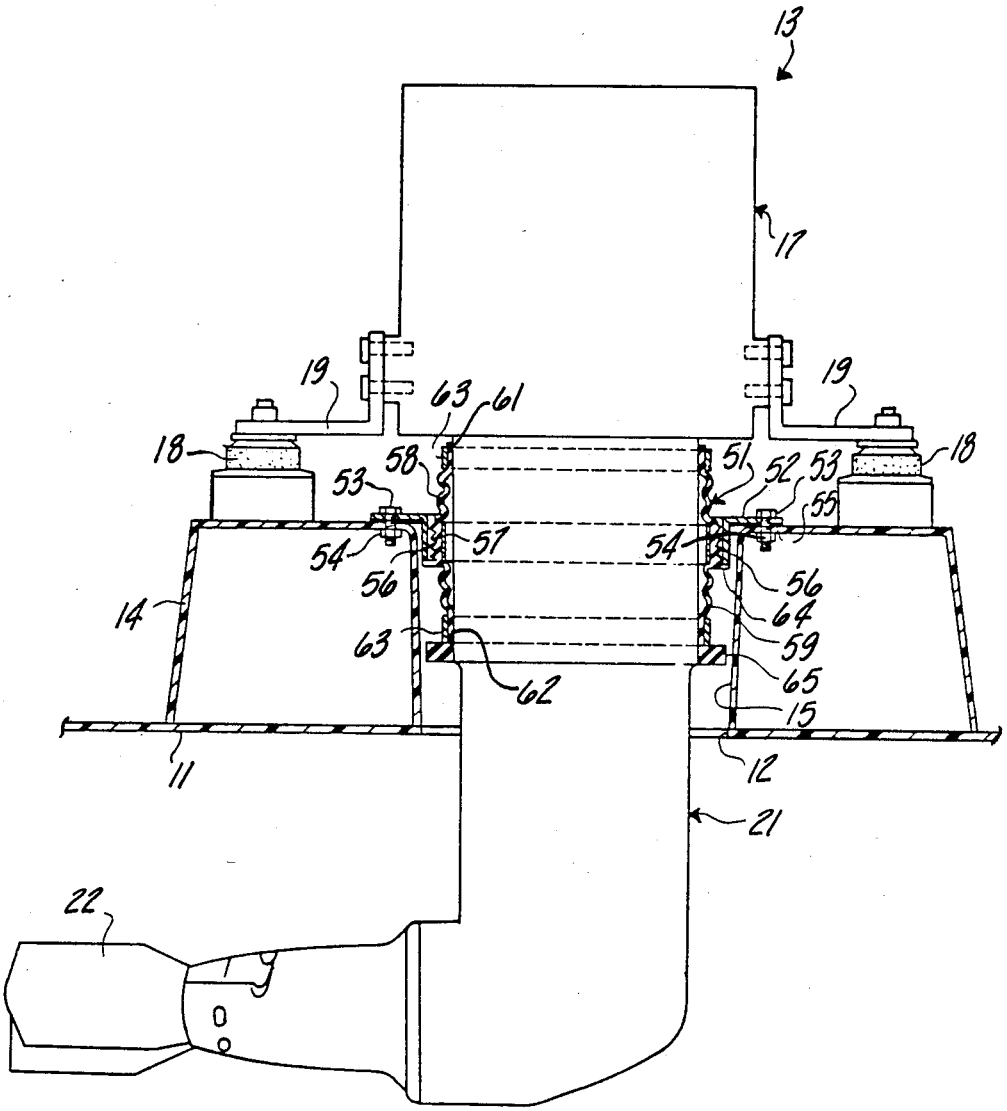
FIG. 3 is a side elevational view with portions shown in section and other portions broken away, in part similar to FIGS. 1 and 2, and shows a seal constructed in accordance with a second embodiment of the invention.
Figure 4:
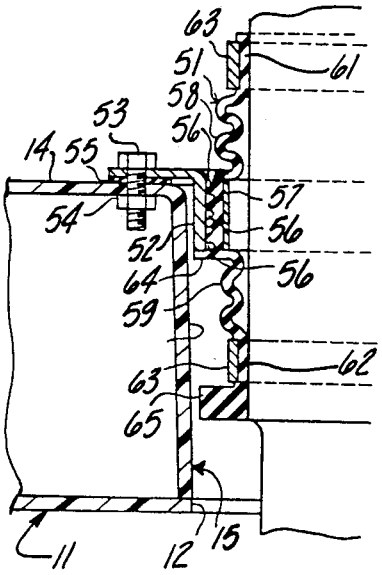
FIG. 4 is an enlarged, cross-sectional view showing the seal of the embodiment of FIG. 3.

Embodiment of FIGS. 3 and 4

A seal constructed in accordance with a second embodiment of the invention is identified generally by the reference numeral 51. As with the previously described embodiment, the seal 51 is adapted to be relatively permanently connected to the support 14 and is sized so as to permit passage of the drive unit 21 for insertion and removal of the auxiliary power unit 13. In this embodiment, however, the seal 51 seals the drive unit 21 in two spaced locations. In this embodiment rather than engaging directly the mounting structure opening 15, the seal 51 cooperates with a sealing member 52 that may be formed from metal and which has a radially extending portion that is affixed to the upper surface of the support 14 by means of a plurality of bolts 53 and nuts 54 with a gasket 55 position therebetween to effect a water tight seal between the support 14 and the sealing member 52 around the opening 15.

The seal 51 is comprised on an elongated, elastomer sleeve having an intermediate portion that is formed with one or more radially outwardly extending ribs 56 of a generally saw-tooth configuration that sealingly engage the circumferential opening defined by the sealing member 52. As with the previously described embodiments, the ribs 56 extend adjacent a reinforcing member 57 of generaly annular configuration which is either molded into or formed on the inner periphery of the intermediate portion of the seal 51.

Bellows-like portions 58 and 59 extendward upwardly and downwardly from the intermediate portion of the seal 51 and terminate in cylindrical portions 61 and 62 respectively that define an opening that is adapted to slidingly pass the drive unit 21. Clamps 63 are adapted to cooperate with the portions 61 and 62 so as to effect a seal between these portions and the drive unit 21.

At the juncture of the upper portion of the bellows 59 with the intermediate ribbed portion, a radially outwardly extending flange 64 is formed. The flange 64 sealingly engages the lowermost periphery edge of the sealing member 52 so as to provide a further seal in this area. This seal is comparable to the seal provided by the flange 33 in the embodiment of FIG. 2.

Adjacent the seal portion 62, there is formed a heavy annular projection 65 that is spaced inwardly from the opening 15. The bellows portions 58 and 59 permit vibratory movement of the auxiliary power unit 13 relative to the mounting structure 14. However, extreme movements such as occur if the drive unit 21 strikes a submerged object will be limited by contact of the flange 65 with the opening 15. Thus, direct contact between the rigid components will be precluded so as to minimize the likelihood of damage to either the power unit 13 or the hull 11 while, at the same time, permitting sufficient movement for effective vibration damping.

The seal 51 will be maintained in sealing engagement with the sealing member 52 when the clamps 63 are relaxed so as to permit insertion or removal of the auxiliary power unit 13 through the relaxed sealing sleeves 61 and 62. However, when the auxiliary power unit 13 is in place, an effective seal will be provided by tightening the clamps 63. In other regards this embodiment has the same advantages as the embodiment of FIG. 2, in addition to the further advantages described above.

Figure 5:
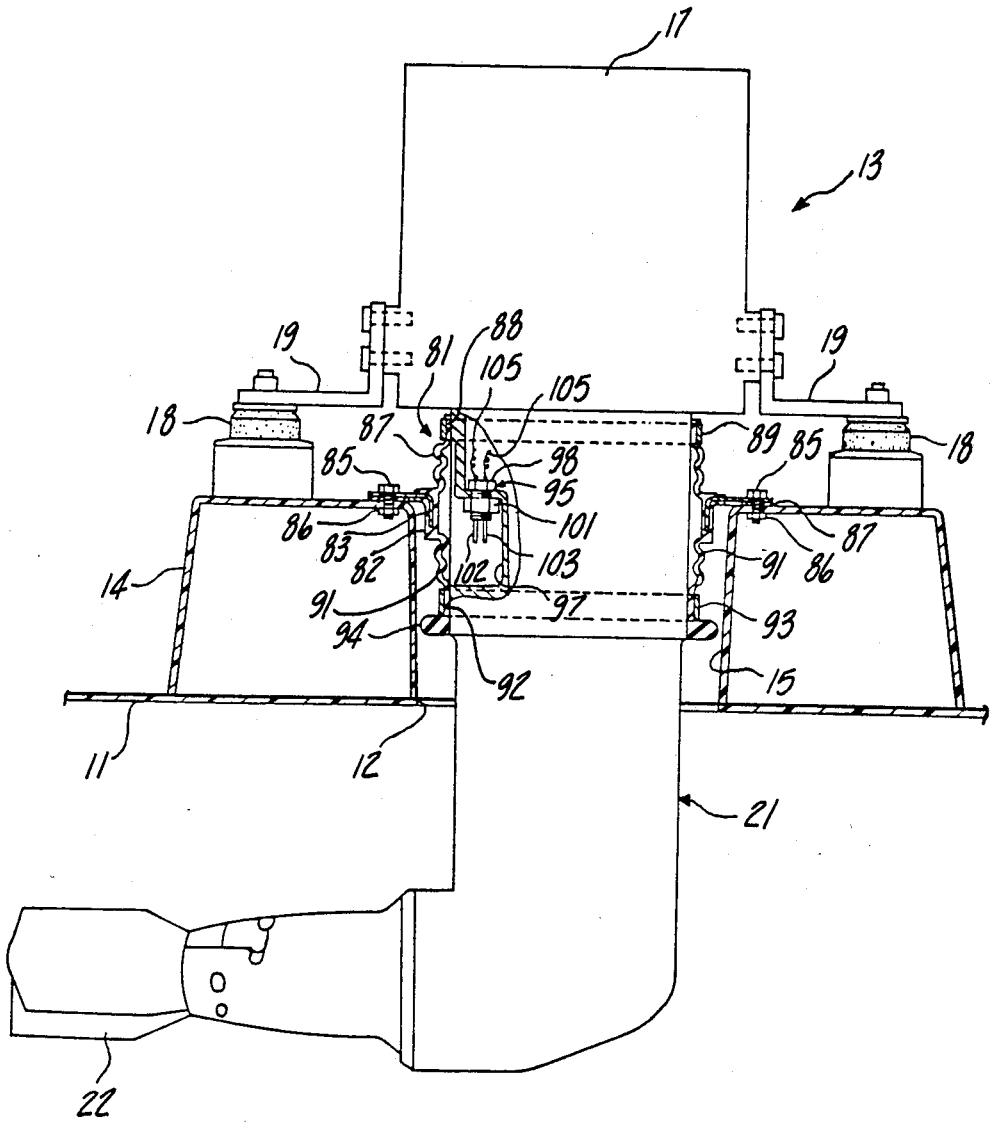
FIG. 5 is a side elevational view, with portions broken away and other portions shown in section, in part similar to FIGS. 1, 2 and 3, and shows a seal and sensing unit constructed in accordance with a still further embodiment of the invention.
Figure 6:
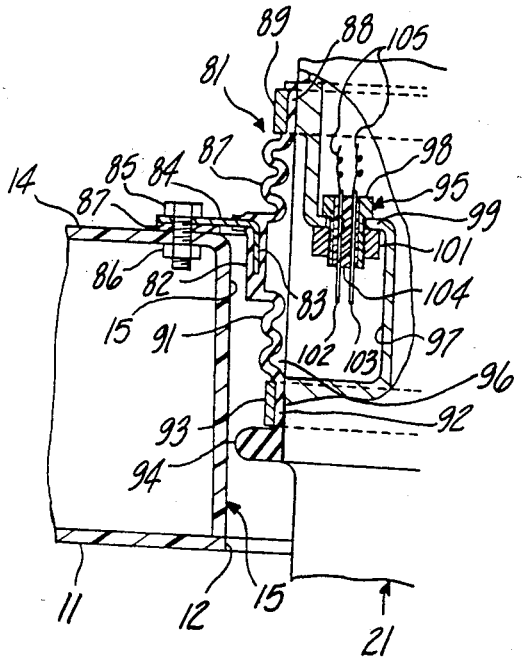
FIG. 6 is an enlarged, sectional view of the seal and sensing arrangement of the embodiment of FIG. 5.

Embodiment of FIGS. 5 and 6

FIGS. 5 and 6 illustrate a still further embodiment of this invention. In this embodiment a seal, indicated generally by the reference numeral 81, is provided between the auxiliary power unit 13 and the hull 11 and support 14. In some regards this embodiment is similar to the embodiment of FIGS. 3 and 4 in that the seal 81 provides both an upper seal and a lower seal. In this embodiment, however, the seal 81 is mechanically connected to the support 14 rather than being retained in the support through its inherent resilience. In addition, a sensing device is provided for providing an indication if the lowermost seal has failed and water is permitted to enter into the area between the seals.

In this embodiment the seal 81 includes an intermediate portion 82 which is formed from an elastomeric material and which is bonded to a downwardly extenting leg 83 of a metallic clamping member 84. The clamping member 84 is held in engagement with the upper surface of the support 14 by means of a plurality of bolts 85 and nuts 86. The seal intermediate portion has an outwardly extending sealing portion 87 that underlies the clamping bracket 84 and which affords a fluid tight seal between this bracket and the support 14.

Extending upwardly and integrally connected to the intermediate portion 82 is a first bellows part 87. The bellows part 87 terminates in a first annular sealing part 88 which, as in the embodiment of FIGS. 3 and 4, has an opening that is adapted to freely pass the drive unit 21. A clamp 89 is provided for urging the sealing part 82 into sealing engagement with the drive unit 21 when the auxiliary power unit 13 is being used.

The second bellows part 91 extends integrally downwardly from the intermediate portion 82 and terminates in a second sealing part 92, which also has an opening adapted to freely pass the drive unit 21. A clamp 93 is provided for urging the second sealing part 92 into sealing engagement with the drive unit 21.

As with the previously described embodiment, a more rigid outwardly extending annular flange 94 is formed adjacent the sealing part 92 and is juxtaposed to the opening 15. If the driving unit 21 strikes an obstacle, the flange 94 will contact the support 14 so as to limit further movement, to afford resilient protection and to avoid damage to the seal 81.

A sensing device, indicated generally by the reference numeral 95, is provided to indicate if there is failure of either the seal 88 or the seal 92 such that water can escape into an area, indicated generally by the reference numeral 96, between these two seals. More normally, if such failure occurs, it will be in the area of the bellows 91 or lower seal 92.

The sensing device 95 is supported in a recess 97 of the portion of the lower unit 21 between the area engaged by the sealing portions 88 and 92. The recessed area 97 is offset so that the auxiliary power unit 13 may be removed or installed when the clamps 89 and 93 are released without interference between the sensing device 95 and the seal 81.

The sensing device 95 includes a bolt-like member 98 that passes through an opening in a horizontal wall 99 of the drive unit 21 which forms the upper limit of the recess 97. A nut 101 is threaded on to the lower end of the bolt-like member 98 so that both sides of the wall 99 are clamped and the sensing device 95 will be locked in place.

A pair of sensing terminals 102 and 103 extend through and are supported by an insulator 104 that passes centrally through the bolt-like member 98. The terminals 102 and 103 are spaced apart and are connected by conductors 105 to a warning device, guage or other suitable indicator.

In the event a failure occurs in the lower seal, water may pass into the area 96. The presence of water between the terminals 102, 103 will reduce the electrical resistance between these terminals and provide a signal in any suitable or known manner. Thus, the seal 81 can be repaired before both seals have failed and protection will be readily assured.

The construction of this embodiment permits insertion and removal of the auxiliary power unit 13 through the seal 81 without necessitating removal of the sensing device 95. Furthermore, the sensing device 95 is positioned in the reccess 97 so that it will not be damaged by or damage the seal 81 during insertion and removal. Furthermore, replacement of the sensing device 95 may be accomplished without removal of the seal or without necessitating disturbance of the seal 81 once the power unit 13 is removed.

It should be readily apparent that the described embodiments are effective in providing a seal between the auxiliary power unit and the hull of a water craft, while at the same time insuring against damage to the seal during successive removal and insertion of the power unit. Furthermore, in some embodiments a double seal is provided, and additionally a more positive resilient stop is provided by the seal to absorb or limit large magnitude movements as may occur under extreme vibrations or when the power unit strikes an underwater obstruction. The construction of the seal, however, in each embodiment affords good vibration damping without deterioration of the seal. A sensor arrangement is also incorporated for indicating water leakage and which itself will not cause damage to the seal or the sensor when the power unit is installed or removed. Although a number of embodiments have been illustrated and described, various further changes and modifications may be made without departing from the spirit and scope of the invention, as defined by the appended claims.

I claim:

1. A sealing arrangement for a hull and an auxiliary power unit comprising an internal combustion engine, a drive housing fixed relative to said engine and carrying a propeller driven by said engine, whereby the hull defines a hole through which a portion of the auxiliary power unit drive housing and said propeller are adapted to pass comprising an elastomer seal adapted to provide an operative seal between the hull and the power unit, the improvement comprising said elastomer seal having a first part for sealingly engaging the area around said hole, fixing means for fixing said seal relative to the hull and independently of the power unit, said seal also having a second part defining an opening sized to pass the power unit for insertion and removal of said power unit portion through said opening while said first part is retained in sealing engagement with the area around said hole by said fixing means, a resilient bellows section interconnnecting said first and second parts, clamping means for detachably affixing said second part in sealing engagement with the power unit portion, a third part spaced from said second part and also defining an opening sized to pass the power unit, and fourth means for detachably affixing the third part in sealing engagement with the power unit.

2. A sealing arrangement as set forth in claim 1 wherein the second and third parts of the seal are disposed on opposite sides of the first part and connected thereto by respective resilient bellows sections.

3. A sealing arrangement as set forth in claim 1 wherein the first part comprises an outwardly projecting resilient sealing rib sealingly engaging the area around the hole and comprising the fixing means.

4. A sealing arrangement as set forth in claim 3 wherein there are a plurality of axially spaced sealing ribs.

5. A sealing arrangement as set forth in claim 4 further including a substantially rigid backup member affixed to the seal in proximity to the rib.

6. A sealing arrangement as set forth in either claims 1 or 2 further including water sensing means interposed in the space between the second and third parts for detecting the leakage of water.

7. A sealing arrangement as set forth in claim 6 wherein the water sensing means is supported independently of the seal.

8. A sealing arrangement as set forth in claim 7 wherein the water sensing means means is carried by the power unit.

9. A sealing arrangement for a hull and an auxiliary power unit comprising an internal combustion engine, a drive housing fixed relative to said engine and carrying a propeller driven by said engine, whereby the hull defines a hole through which a portion of the auxiliary power unit drive housing and said propeller are adapted to pass comprising an elastomer seal adapted to provide an operative seal between the hull and the power unit, the improvement comprising said elastomer seal having a first part for sealingly engaging the area around said hole, fixing means for fixing said seal relative to the hull and independently of the power unit, said seal also having a second part defining an opening sized to pass the power unit for insertion and removal of said power unit portion through said opening while said first part is retained in sealing engagement with the area around said hole by said fixing means, a resilient bellows section interconnecting said first and second parts, clamping means for detachably affixing said second part in sealing engagement with the power unit portion, and a stop portion formed on said seal and extending outwardly and normally spaced from the area defining the hole for engaging the area to resiliently cushion large degrees of relative movement between the power unit and the hull.

10. A sealing arrangement as set forth in claim 9 wherein the seal further comprises a third part spaced from the second part and also defining an opening sized to pass the power unit and fourth means for detachably affixing the third part in sealing engagement with the power unit.

11. In a sealing arrangement for a hull and an auxiliary power unit wherein the hull defines an opening through which a portion of the auxiliary power unit is adapted to pass comprising an elastomer seal adapted to provide an operative seal between the hull and the power unit, the improvement comprising said elastomeric seal having a first part for sealingly engaging the area around said hole, a second part spaced from said first part and adapted to sealingly engage said auxiliary power unit portion, said first and said second parts being connected by a resilient bellows section for permitting vibration of said auxiliary power unit relative to said hull, a third part adapted to be fixed to one of the hull and the auxiliary power unit and normally spaced from the other thereof and adapted to engage such other for limiting the degree of relative movement, and a fourth part adapted to sealingly engage the auxiliary power unit portion, said second and fourth parts being spaced on opposite sides of said first part, said fourth part being connected to said first part by a second bellows section.

12. A sealing arrangement as set forth in claim 11 wherein the second and third parts are juxtaposed to each other.

* * * * *